United States Patent [19]

Easwaran

[11] Patent Number: 4,995,443

[45] Date of Patent: Feb. 26, 1991

[54] PROCESS FOR EVAPORATIVE PATTERN CASTING

[75] Inventor: Jay Easwaran, Portage, Mich.

[73] Assignee: The Board of Trustees of Western Michigan University, Kalamazoo, Mich.

[21] Appl. No.: 308,313

[22] Filed: Feb. 8, 1989

[51] Int. Cl.[5] ..... B22C 9/02

[52] U.S. Cl. ..... 164/34; 164/35

[58] Field of Search ..... 16/34–36, 16/24, 516, 517, 519

[56] References Cited

U.S. PATENT DOCUMENTS

| | | | |
|---|---|---|---|
| 2,441,695 | 5/1948 | Feagin et al. | 164/516 |
| 2,948,032 | 8/1960 | Reufer | 164/519 |
| 3,010,852 | 11/1961 | Prange | 164/35 |
| 3,239,897 | 3/1966 | Lirones | 164/517 |

FOREIGN PATENT DOCUMENTS

| | | | |
|---|---|---|---|
| 18210 | 6/1976 | Japan | 164/34 |
| 3850 | 1/1987 | Japan | 164/34 |

*Primary Examiner*—Richard K. Seidel
*Assistant Examiner*—Edward A. Brown
*Attorney, Agent, or Firm*—Flynn, Thiel, Boutell & Tanis

[57] ABSTRACT

A method is disclosed for the casting of metals by the use of a consumable or evaporative pattern. In this method, a foamed pattern of a desired part is first formed. The pattern is then dipped into a ceramic slurry and the slurry dried in order to form a shell containing the foamed pattern. A heated bed of a particulate medium is formed around the ceramic shell which causes the pattern to evaporate and form a mold. A molten metal is then introduced into the mold, solidified and removed from the mold to form a casting.

21 Claims, No Drawings

PROCESS FOR EVAPORATIVE PATTERN CASTING

BACKGROUND OF THE INVENTION (1) Technical Field

This invention relates to the formation of metal parts by the use of foam patterns which are consumed or evaporated during the casting of the metal.

(2) Description of the Prior Art

The casting or molding of metals is an art that has been in existence for a very long time and yet, surprisingly, has not experienced very many changes with respect to the basic techniques or materials used in the process.

A typical prior art process for making a casting is by the "lost foam" or "evaporative pattern casting" method. This method initially requires the formation of a foam pattern out of a consumable polymeric material.

This foam pattern is then dipped or coated with a ceramic slurry and placed in a bed of dry, loose, cool sand. The sand bed is thoroughly vibrated to compact the particles around the coated pattern. After the compaction is completed, molten metal is poured directly onto the polymeric pattern. The pattern gradually evaporates as it comes in contact with the molten metal. The products of evaporation, mostly gases, are vented into the dry sand bed, leaving behind a cavity for the molten metal to fill. As the evaporation, followed by filling by molten metal is completed, an exact replica of the polymeric pattern is reproduced in metal.

This typical prior art process of "lost foam" casting has problems in that the formation of the ceramic shell is costly and time consuming. The porosity of the ceramic shell also has to be carefully controlled in order to allow the gases evolved during the evaporation of the polymeric pattern exit through the shell. Another problem with this conventional process is that the polymeric pattern often decomposes into lustrous carbon and gases which become defect core impurities in the metal part. In order to address this problem, the density of the pattern has to be carefully regulated, which also involves the expenditure of additional time and expense.

There also exists the possibility that the ceramic shell may warp or crack because of the introduction of the molten metal therein. This would necessitate the formation of a new ceramic shell which would entail additional expenditures of time and expense.

In another "lost foam" or "evaporative casting" process, an oven is used to burn out the polymeric foam pattern from the ceramic shell. This process also requires the polymeric foam pattern to be coated with a large number of coats of the ceramic material since the ceramic shell ultimately must support the molten metal, and the problems also arise of damaging the ceramic shell during its removal from the oven and the ceramic shell warping during the burning out of the foam pattern.

Another prior art process for making a casting is the "lost wax" or "investment casting process". The "lost wax" process entails the coating of a wax pattern with a ceramic slurry. The coated wax pattern is inserted into a steam autoclave to remove the pattern. The removal of the wax pattern weakens the ceramic shell so the ceramic shell is heated at temperatures up to 2000° F. in order to strengthen it. Molten metal is then introduced into the ceramic shell in order to form a casting.

Due to the weakness of the ceramic shell, the subsequent handling of the shell in order to introduce the molten metal therein, and the need for the ceramic shell to have sufficient strength to contain the molten metal without external support, from 10–14 coats of the ceramic slurry is applied to the wax pattern. The application of the large number of ceramic coatings consume a great deal of time and money.

U.S. Pat. No. 3 572 417 discloses a method for casting or molding metals in a mold. The mold comprises a refractory inorganic oxide foam which has been formed by heating a filled organic foam at a temperature and time sufficient to substantially decompose an organic binder to a carbonaceous state, or, alternatively, to substantially consume the organic binder to form a refractory inorganic foam. This patent discloses the use of an oven to decompose the organic binder and to fuse or sinter the remaining inorganic components. However, the formation of the "green" mold is an extremely complicated process and the time and expense involved in heating the "green" mold to a temperature sufficient to decompose the organic binder and fuse the remaining inorganic components is unnecessarily high.

U.S. Pat. No. 4 115 504 discloses a method for casting vitreous materials using the lost wax process. In this patent, a pattern of the article to be cast is made using a substance which is vaporized during the casting. Wax, polystyrene and polyethylene are disclosed as being suitable materials for the pattern. The pattern can be coated with a thin layer of a mixture of graphite and a refractory powder and then embedded in a heat resistent silica compound to form a casting mold. The silica compound typically is moistened or contains a cohesive material, such as a resin, in order to insure that the portion of the sand mold adjacent to the surface of the cast articles dries thoroughly. A vitreous material having a viscosity of between 20 and 100 poises is introduced into the mold and decomposes the pattern. The article formed in the mold can be ceramified by fluidizing the sand by means of a hot stream of gas. It is to be noted that this reference deals with the formation of a vitreous article, not a metal article, and requires that the viscosity of the casting material be maintained in a certain range in order for the casting material not to pierce the mold.

U.S. Pat. No. 4 640 728 discloses a method of joining foam patterns which are used in evaporative casting processes. This patent discloses a method of assembling complex, consumable foam patterns for use in evaporative pattern metal casting but gives no particulars as to the evaporative pattern process per se.

It is an object of the present invention to provide a method for forming a cast metal article by the evaporative casting process which does not contain the drawbacks of the processes used in the prior art.

More specifically, it is an object of the present invention to provide an evaporative casting process which does not require the formation of a ceramic shell comprised of a large number of individual layers of the ceramic material.

It is an additional object of the present invention to provide an evaporative casting process in which the porosity of the ceramic shell is not a factor and which reduces the possibility of the ceramic shell warping or cracking during subsequent uses.

It is a further object of the present invention to provide an evaporative casting process which forms a cast metal article not having gas or lustrous carbon defects present in the casting.

It is a still further object of the present invention to provide an evaporative casting process which minimizes the pollution problems caused by the vaporization of a decomposable pattern used in the casting process.

It is a still further object of the present invention to improve the surface finish and dimensional attributes of the cast parts made by the evaporative casting process.

SUMMARY OF THE INVENTION

These and other objects of the present invention are accomplished by providing an evaporative casting process which uses a heated particulate medium as a means for supporting the ceramic shell and decomposing the polymeric pattern contained in the ceramic shell. The particulate medium can be coated with a catalytically active material to aid in the control of fumes generated during the decomposition of the polymeric pattern.

The particulate medium serves as a means for support for the ceramic shell during the casting process and thereby enables the ceramic shell to be much thinner, i.e., comprise fewer ceramic layers, than is possible in the prior art processes. The particulate medium also provides support for the ceramic shell during the evaporation of the foam pattern. This reduces the possibility of the shell warping or cracking during the evaporation stage and the heat from the particulate medium hardens the shell. The complete decomposition of the polymeric pattern by the heated particulate medium also eliminates gaseous and lustrous carbon defects in the cast part because the polymeric pattern is completely removed from the casting shell before the metal is introduced therein.

In a further embodiment of the present invention, the heated particulate medium surrounding the ceramic shell is replaced by a cooler particulate medium while still maintaining constant support of the ceramic shell thereby allowing the casting of non-ferrous metals by the process. The cast metal articles can be annealed while in the ceramic shell and, if the shell is removed from the heated sand and cracked open, the articles can be quenched in ambient air.

DETAILED DESCRIPTION

The evaporative casting process of the present invention requires an expendable or consumable foam replica or pattern of the part to be cast. Suitable materials of construction for the pattern are materials which will decompose at the temperature of the heated sand used in the present process. Preferred materials are polymeric compounds such as polystyrene, polymethyl methacrylate and polyalkyl carbonate with polystyrene and polymethyl methacrylate being especially preferred.

A consumable foam pattern may be prepared in a typical manner such as by introducing polystyrene or polymethyl methacrylate beads into an aluminum die and injecting steam into the die to fuse the polymeric material and form a pattern. With the present invention, the density of the consumable pattern is not critical. However, in order to avoid combustion problems during the vaporization of the pattern, when polystyrene is used as the material of construction for the consumable pattern, a preferred density of the pattern is about 1 $lb/ft^2$.

After the pattern is formed, it is assembled with the necessary gating, pouring cups, and sprues that will be necessary to introduce the molten metal into the evacuated ceramic shell.

This pattern assembly is then disposed on a hook and dipped in a tank of ceramic slurry comprising a fused silica refractory, a colloidal silica binder and water. The average particle size of the fused silica is not critical and may range from about 50 mesh to about 400 mesh. A preferred average particle size is between about 100 mesh and 300 mesh with an average particle size of about 200 mesh being especially preferred. The amount of colloidal silica binder present in the slurry is dependent on the particle size and amount of fused silica present. A desirable amount of colloidal silica is between 5–10% by weight based on the weight of the fused silica in the slurry. The ceramic slurry is preferably maintained at about 60 per cent solids but the temperature of the slurry is not critical and can be maintained at ambient temperatures. Although a specific type of ceramic slurry is described above, in the present invention, the term "ceramic" is intended to cover any suitable inorganic material.

After the pattern assembly is completely wetted by the ceramic slurry, it is removed from the slurry bath and placed in a fluidized bed of fused silica powder. The fused silica powder has a particle size of about −50 to +100 mesh and air or any other suitable fluidizing gas is used as the fluidizing medium. The pattern assembly is disposed in the fluidized bed of fused silica powder until it is completely coated with the powder. The ceramic slurry coating and the fused silica coating together constitute an initial ceramic shell layer. After the initial ceramic shell layer is formed on the pattern assembly, the assembly is removed from the fluidized bed of fused silica powder and the initial shell layer dried in air. The coating steps are repeated between 1–5 times to produce a strong enough final ceramic shell for the subsequent casting operations. The porosity of the final ceramic shell is not critical but desirably, the thickness of the final ceramic shell is approximately 6–25 mm. thick.

After the final ceramic shell is air dried, a bed of a dry particulate medium, which is heated to a temperature between 1500–2000° F. and contained in a suitable container for the process conditions is formed around the entire assembly. The material of construction of the container can be any glass, ceramic or metal that can withstand the process conditions and a preferred particulate medium is sand. The particulate medium preferably have a spherical or angular shape and a size distribution between −40 mesh to +200 mesh. The sand particles can be silica, alumina, zirconia or olivine and combinations thereof with olivine being preferred.

The particulate medium may additionally be coated with a catalytic material which aids in the pollution control of the gases of the vaporized pattern by suppressing the formation of elemental carbon. The amount of catalyst used with respect to the weight of the particulate medium is dependent on the amount and type of material used to make the pattern and the type of catalyst used. When platinum is used, a desirable weight percent is 0.01% with respect to the weight of the particulate medium. The platinum is deposited on the particulate medium by dipping it into a platinum containing solution, such as platinum chloride, and then drying the coated particulate medium.

The bed of heated particulate medium can be formed around the ceramic shell containing the polymeric mold by pouring the heated particulate medium around the ceramic shell, introducing the ceramic shell into a fluidized bed of a heated particulate medium and compacting the fluidized bed around the ceramic shell, or inserting the ceramic shell into a quiescent bed of the heated particulate medium. A preferred method of forming the bed of heated particulate medium around the ceramic shell is to insert the ceramic shell into a fluidized bed of a heated particulate medium and compact the fluidized bed around the ceramic shell.

When the pattern assembly is completely covered by the heated particulate medium, the level of the particulate medium should be just sufficient to be flush with the top of the pouring cup.

The pattern assembly is rapidly heated to a high temperature by the hot particulate medium and the consumable pattern vaporized therefrom. In order to avoid pollution problems, the consumable pattern is preferably vaporized in an inert atmosphere such as a nitrogen-/argon atmosphere. These gases can also be used as the fluidizing medium for the particulate medium.

When the decomposition of the pattern is carried out in an ambient atmosphere, dark smoke will be produced from the combustion of the consumable pattern. This smoke will be comprised of various hydrocarbons and gaseous carbon. This smoke should be captured and incinerated to maintain healthy working conditions. The use of a particulate medium coated with a catalytically active material aids in the control of the liberated gases by reducing the amount of gaseous carbon generated.

Once the entire consumable pattern is evaporated by the heated particulate medium from the ceramic shell to form a mold, molten metal is introduced into the mold by way of the pouring cup. The particulate medium provides support for the mold during the pouring of the molten metal, allows the mold to be supported without movement, and reduces the possibility of the ceramic shell cracking or warping during the introduction of the molten metal.

If a non-ferrous metal is used as the casting material, a cool fresh particulate medium is used to replace the heated particulate medium in the container holding the heated particulate medium after the molten metal has been poured into the mold. The temperature of the cool particulate medium is preferably from about room temperature to about 125° F. The heated particulate medium can be withdrawn from the bottom of the container and the cool fresh particulate medium introduced through the top of the container.

After the cast metal has cooled and solidified, it can be removed from the mold to form the cast metal part.

The following examples will serve to illustrate the present invention.

EXAMPLE 1

A polystyrene pattern of an automobile exhaust manifold was prepared from pre-expanded beads of polystyrene. The pattern was made in a modified injection molding machine using an aluminum die with a steam chest. The pre-expanded beads were blown into the die cavity with compressed air. When the blowing was completed, steam was released around the cavity. The heat from the steam fused the polystyrene beads together making them assume the shape of the die cavity.

When the steam injection was completed, cooling water was circulated in the die cavity and the pattern ejected. The resulting pattern had a density of 1.2 lbs. per cu. ft. This pattern was allowed to settle at room temperature for one week prior to its use.

The settled pattern was attached to sprues and gates made of the same polystyrene foam. The attachment was made with a conventional hot glue gun.

After the glue had set, the entire polystyrene assembly was immersed in a slurry containing fused silica with an average particle size of 200 mesh. This fused silica was dispersed in water with colloidal silica as a binder. After the pattern assembly was completely wetted with this slurry, the assembly was removed and coated with dry fused silica, with particle sizes of −50 mesh to +100 mesh, in a fluidized bed. When the dry particles had attached to the wet slurry, the pattern assembly was dried in ambient air for about four hours.

After this initial coating had dried, a back-up slurry coating was applied. Fused silica flour with an average particle size of 120 mesh was mixed with water and colloidal silica binder to form a slurry. The coated and dried pattern assembly was dipped in this slurry until it was completely wetted by the slurry. The pattern was removed from the slurry and coated with dry fused silica flour with a particle size range of −30 mesh to +50 mesh in a fluidized bed. When this dry coating had adhered to the wet slurry, the entire pattern was taken out of the fluidized bed and allowed to dry in air.

This second coating (called the back-up coating) was administered one more time until the coating on the pattern had built up to a thickness of 0.25 inches.

The fully coated and dried pattern assembly was lowered into a fluidized bed containing aluminum oxide particles (between 60–100 mesh), heated to a temperature between 1600° F.–1700° F. After the pattern assembly was fully lowered into the fluidized bed, the air supply was shut off and the entire assembly was gently vibrated. The aluminum oxide particles completely surrounded the pattern assembly and raised its temperature to a point where the pattern began to vaporize by the heat. Within one minute, the entire polystyrene pattern had burnt away as evidenced by the black smoke emerging from the ceramic shell.

When the evolution of the black smoke stopped, an empty hard shell was left in the fluidized bed. This shell was now ready to receive molten metal to form a casting. Molten metal could be poured into the shell cavity as is, or the heated shell could be removed from the fluidized bed prior to pouring.

Castings were made from ductile iron and carbon and stainless steel. Surface finish and dimensional measurements of the castings showed that they were true reproductions of the pattern. Castings made by this procedure were also free of lustrous carbon defects that are normally present in conventional lost foam castings.

EXAMPLE 2

In this example, the total thickness of the coating was increased to 1 inch. All other procedures were identical to Example 1. Excellent castings of ductile irons and steel free from lustrous carbon defects were made.

EXAMPLE 3

In this example, the polystyrene pattern assembly had a density of 2.5 lbs. per cu. ft. All other procedures were identical to Example 1. Excellent castings of ductile irons and steels were made.

EXAMPLE 4

This example was identical to Example 1, except that the pattern assemblies which had been coated and dried were lowered into a heated fluidized bed containing aluminum oxide particles coated with a platinum catalyst. The presence of the catalyst eliminated the black carbonaceous smoke that was evidenced during the burning of the polystyrene.

EXAMPLE 5

This example was conducted identical to Example 1, except that the number of coats applied to the polystyrene pattern was reduced to four. Again, excellent castings free from lustrous carbon defects and true reproductions of the pattern were made.

Although particular preferred embodiments of the invention have been disclosed in detail for illustrative purposes, it will be recognized that variations or modifications of the disclosed invention, including the rearrangement of process steps, lie within the scope of the present invention.

I claim:

1. A method of producing a cast metal part comprising the steps of forming a pattern of the metal part out of a heat decomposable material; forming a ceramic shell around said pattern; forming a bed of a heated particulate medium around said ceramic shell; decomposing the pattern to form a mold; introducing molten metal into said mold without removing said mold from said heated particulate medium bed; solidifying said molten metal; and removing said solidified molten metal from said mold to form a cast metal part.

2. The method of claim 1, wherein said shell has a thickness of approximately 6 mm.

3. The method of claim 1, wherein said heat decomposable material is a polymer.

4. The method of claim 3, wherein said polymer is selected from the group consisting of polystyrene and polymethyl methacrylate.

5. The method of claim 1, wherein said heated particulate medium is at a temperature of about 1500° to 2000° F.

6. The method of claim 1, wherein said pattern is decomposed in an inert atmosphere.

7. The method of claim 1, wherein said metal is a non-ferrous metal.

8. The method of claim 1, wherein said metal is a ferrous metal.

9. The method of claim 1, wherein said ceramic shell consists essentially of 2–5 layers of a ceramic material.

10. The method of claim 9, wherein said ceramic shell consists essentially of 2 layers of a ceramic material.

11. The method of claim 9, wherein each layer of ceramic material is formed by applying a ceramic coating to said pattern and drying said ceramic coating.

12. The method of claim 11, wherein prior to the drying of said ceramic coating, a fused silica coating is applied to said ceramic coating.

13. The method of claim 12, wherein 2–3 coatings of said ceramic coating and said fused silica coating are each applied to said pattern.

14. The method of claim 12, wherein said ceramic shell has a thickness of approximately 6 mm.

15. The method of claim 12, wherein said polymeric material is selected from the group consisting of polystyrene and polymethyl methacrylate.

16. The method of claim 1, wherein said heated particulate medium is sand.

17. The method of claim 1, wherein said bed of heated particulate medium is formed around said ceramic shell by inserting said ceramic shell in a bed of a heated fluidized particulate medium and compacting said heated fluidized particulate medium around said ceramic shell.

18. The method of claim 17, wherein said heated fluidized particulate medium is sand.

19. A method for producing a cast metal part comprising the steps of forming a pattern of the metal part out of a polymeric material; applying 2–5 ceramic coatings to said pattern and drying each ceramic coating prior to the application of a subsequent ceramic coating to form a ceramic shell containing said pattern; applying a fused silica coating to each ceramic coating prior to said drying of said each ceramic coating; introducing said ceramic shell into a bed of fluidized sand at a temperature of about 1500°–2000° F.; compacting said fluidized sand around said ceramic shell; decomposing said pattern to form a mold; introducing molten metal into said mold without removing said mold from said compacted sand; solidifying said molten metal; and removing said solidified molten metal from said mold to form a cast metal part.

20. A method of producing a cast metal part comprising the steps of forming a pattern of the metal part out of a heat decomposable material; forming a ceramic shell around said pattern; forming a bed of a heated particulate medium around said ceramic shell; decomposing the pattern to form a mold; introducing a molten metal into said mold; replacing said heated particulate medium around said mold containing said molten metal with a particulate medium at a lower temperature than said heated particulate medium; solidifying said molten metal; and removing said solidified molten metal from said mold to form a cast metal part.

21. A method of producing a cast metal part comprising the steps of forming a pattern of the metal part out of a heat decomposable material; forming a ceramic shell around said pattern; forming a bed of a heated particulate medium around said shell, said heated particulate medium having a platinum-containing coating provided thereon; decomposing the pattern to form a mold; introducing a molten metal into said mold; solidifying said molten metal; and removing said solidified molten metal from said mold to form a cast metal part.

* * * * *